United States Patent [19]

Rotter et al.

[11] Patent Number: 4,922,666

[45] Date of Patent: May 8, 1990

[54] PORCH WITH RECESSIBLE WINDOWS

[76] Inventors: Bernard J. Rotter, 9001 Chesshire La., Maple Grove, Minn. 55369; Timothy M. Whitten, 8980 Neill Lake Rd., Eden Prairie, Minn. 55344; Silas A. Brown, P.O. Box 86, Marine on the St. Croix, Minn. 55047

[21] Appl. No.: 305,517

[22] Filed: Feb. 2, 1989

[51] Int. Cl.[5] ..... E04B 1/346; E04B 1/04

[52] U.S. Cl. ..... 52/66; 52/67; 52/207; 52/474; 52/632; 49/125; 160/193

[58] Field of Search ..... 52/64, 66–71, 52/72, 73, 474, 632, 207; 49/125, 374; 160/193, 194

[56] References Cited

U.S. PATENT DOCUMENTS

| | | | |
|---|---|---|---|
| 377,736 | 2/1888 | Bishop . | |
| 671,852 | 4/1901 | Brill . | |
| 780,902 | 1/1905 | Müller . | |
| 1,079,525 | 11/1913 | Veiser . | |
| 1,238,704 | 8/1917 | Wendelken . | |
| 1,272,093 | 7/1918 | Ramberg et al. | 49/125 |
| 2,628,391 | 2/1953 | Tourtelotte | 49/374 |
| 3,589,084 | 6/1971 | Reed, III | 52/64 |
| 4,083,149 | 4/1978 | Hickman et al. | 52/64 X |
| 4,180,942 | 1/1980 | Saucier . | |
| 4,443,978 | 4/1984 | Butler | 52/64 X |
| 4,616,451 | 10/1986 | Glick | 52/66 |
| 4,735,023 | 4/1988 | Posner | 52/66 |
| 4,835,920 | 6/1989 | Posner et al. | 52/207 |

*Primary Examiner*—Richard E. Chilcot, Jr.
*Attorney, Agent, or Firm*—James V. Harmon

[57] ABSTRACT

A porch is provided having a ceiling, floor and at least three walls, the fourth wall being in most cases the wall of a house or other building to which the porch is attached. Each wall is made up of a plurality of identical window units or modules in side-by-side relationship and each window module includes a pair of laterally spaced apart vertically disposed parallel frames, one frame on each side. A multi-channel window track is mounted on the side of each frame. Both the frames and the tracks extend from the ceiling down below the floor of the porch. Independently movable window sashes are slidably mounted in each of the channels and are stored when not in use in a pocket at least partially below the floor level so that the lower edge of each window opening is spaced above the floor by a distance less than the height of one of the sashes so that the window openings are close enough to the floor to help promote a visual illusion of being outside.

7 Claims, 6 Drawing Sheets

PORCH WITH RECESSIBLE WINDOWS

FIELD OF THE INVENTION

The present invention relates to building structures and more particularly to a porch structure with recessible windows.

BACKGROUND OF THE INVENTION

In recent years patio living, typically with a barbecue, has become almost a lifestyle. This has created a demand for a porch having the advantages of a roof and optionally screening to provide the same kind of open feeling afforded by a patio so that the floor of the porch is more open visually to the outside, i.e. reads on the lawn or other surroundings outside the porch so that the eye can travel with almost no effort beyond the window to the outside. One objective of the invention is to find a way to provide a porch with windows which will provide the illusion of being outside as on a patio. Recessible windows have been previously proposed but the enclosure required for stored window sashes produces a walled in feeling and destroys the illusion of being outside. An outdoor effect has been partially achieved with floor length picture windows but because the window glass cannot be moved, the feeling of being outside is destroyed.

In view of these deficiencies of the prior art, it is an objective of the present invention to provide a porch with fully enclosing glass windows that nevertheless gives one the feeling of being outside. It is a more specific object of the present invention to provide a modular porch structure having recessible windows in which the window openings extend from the ceiling all the way or almost all the way to the floor. A further object is to provide a modular porch including a modular window opening having several recessible window sashes that do not have to be removed to be placed in storage, which require no counterweights and yet can be easily slid vertically in a multi-channel track and when lowered to a storage position provide a window opening that is spaced from the floor by a distance which is less than the height of a single window sash. A further object is to provide a window opening that extends from the ceiling almost all the way to the floor so that the bottom of the window opening is close enough to the floor to promote the visual illusion of being outside. A further object is to provide a porch having a plurality of side-by-side modular windows and yet is rugged in construction, reliable in operation, low in cost and provides a window wall including a plurality of vertically spaced independently slidable window sashes recessible below the level of the porch floor.

These and other more detailed and specific objects of the invention will be apparent in view of the accompanying specification and drawings which illustrate the invention by way of example.

SUMMARY OF THE INVENTION

The present invention provides a porch having a ceiling, floor and at least three walls. The fourth wall of the porch can be a similar wall or the wall of a house or other building to which the porch is attached. A plurality of identical window units are provided in side-by-side relationship to make up each wall such that substantially the entire wall of the porch is composed of the window units. Each of the window units or modules includes a pair of laterally spaced apart vertically disposed parallel frame units, one such frame on each side of the unit. Multi-channel window tracks are mounted on the sides of each of the frames. The frames and the tracks extend from a point in proximity to the ceiling to an elevation below the level of the floor. Independently movable window sashes are slidably mounted in each of the channels. In this way each sash is slidable in its channel to a storage position at least partially below the level of the floor such that the lower edge of the window opening is spaced above the floor by a distance that is less than the height of a single one of the sashes. The window openings in this way cover substantially the entire wall to thereby promote the visual illusion of being outside.

THE FIGURES

DETAILED DESCRIPTION OF THE INVENTION

Figure 1:
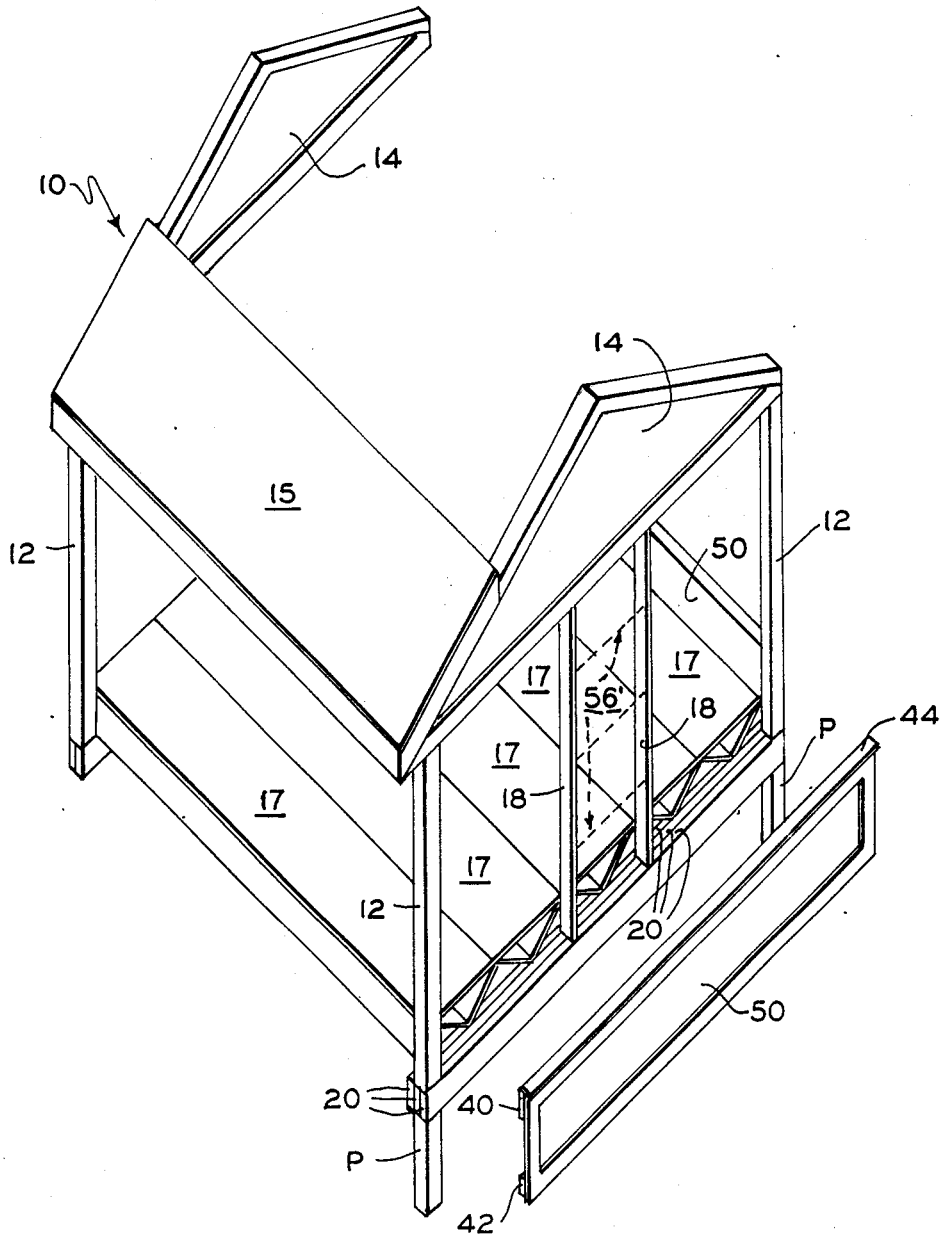
FIG. 1 is a perspective view of the invention as seen from above, partially disassembled for clarity of illustration.
Figure 2:
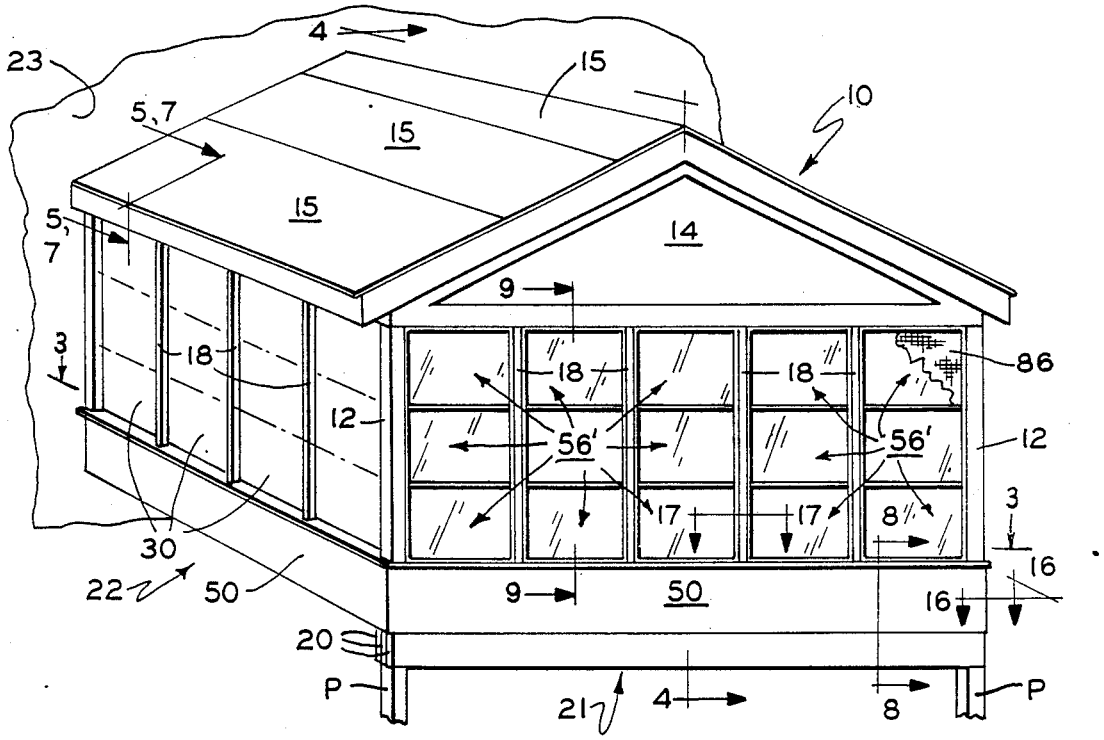
FIG. 2 is a perspective view of the invention as seen from a lower elevation than in FIG. 1.
Figure 3:
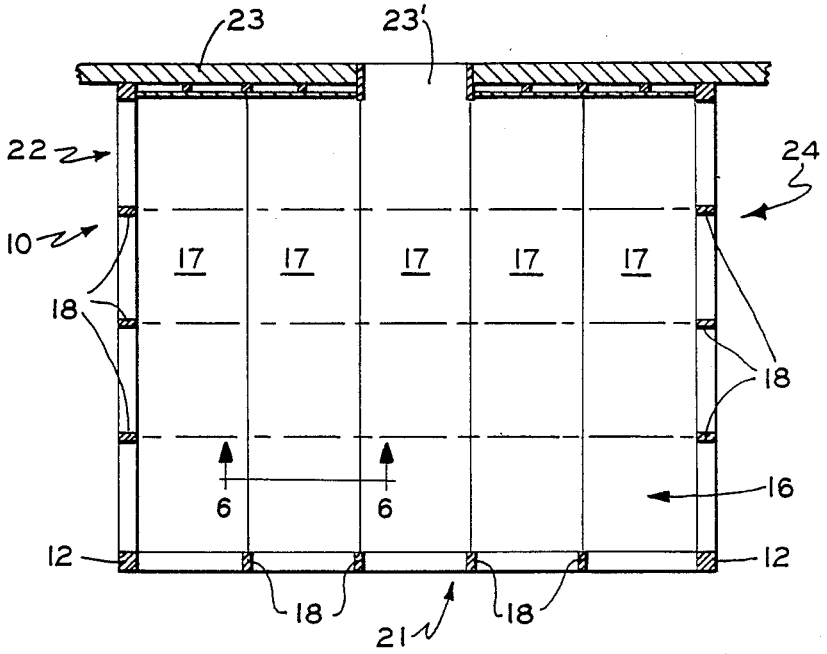
FIG. 3 is a horizontal sectional view taken on line 3—3 of FIG. 2.

Refer now to the figures in which is shown, as seen in FIGS. 1–3, a porch 10 in accordance with the invention composed of corner posts 12 upon which are supported roof trusses 14 (only two of which are shown) which together provide a roof covered by roof panels 15. The ends of the trusses 14 are nailed or bolted to horizontally disposed longitudinally extending ceiling joists 26 (FIGS. 5 and 7) to which soffits 25 are nailed at the upper ends of window frames 18. The ceiling 19 can be supported in part by means of reinforcing panels 19' (FIGS. 5 and 7).

Figure 12:
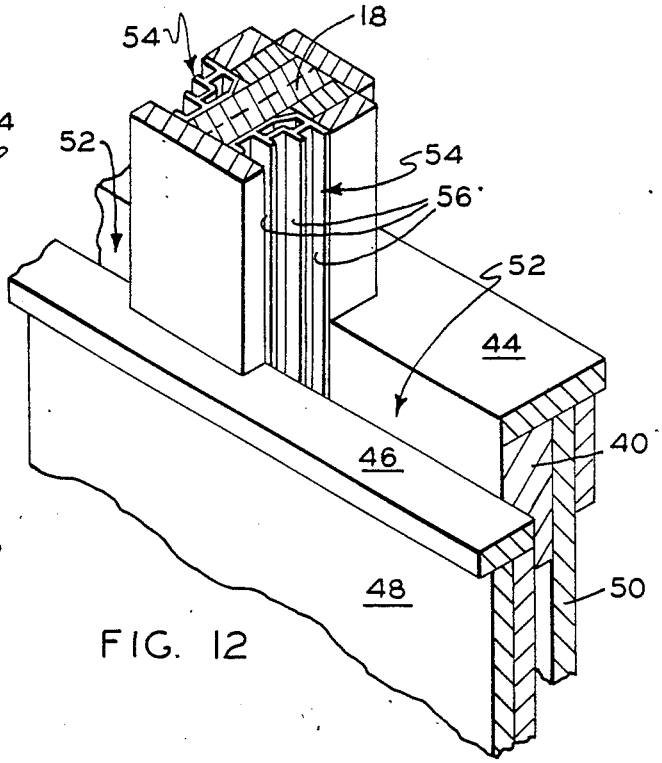
FIG. 12 is a perspective view of a portion of two adjacent window casings.
Figure 13:
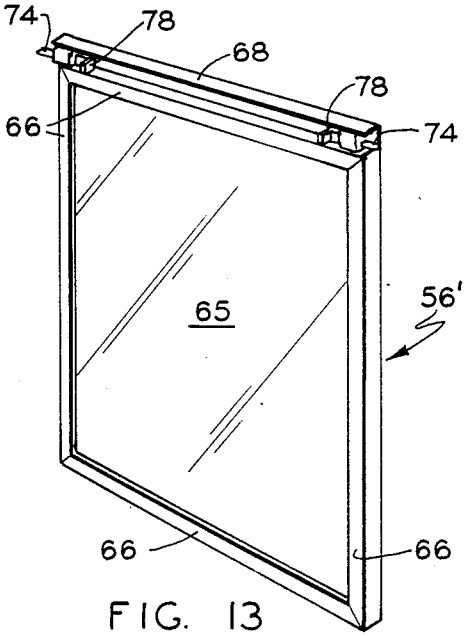
FIG. 13 is a perspective view of one of the window sashes.

The floor indicated generally at 16 is composed of parallel horizontally disposed floor panels 17, in this case five being provided. The floor panels 17 can be supported in part by means of reinforcing members 17' (FIG. 6). The width of the floor panels 17 is the same as the spacing between window frames 18 which are themselves aligned with the edges of panels 17 and extend vertically at the end of the porch 10 between floor beams made up of boards 20 and the truss 14, or in the case of the sidewalls 22 and 24, to a soffit 25 which is nailed to the bottom of a ceiling joist 26 (FIG. 7). The beams 20 can be supported in any suitable manner at their ends, for example as by means of foundation columns 20' (FIG. 2). The window frames 18 of the sidewalls 22 and 24 are spaced apart by the same distance as the window frames 18 on the end wall 21. In this way center lines extending between columns 12 of the sidewalls 22 and 24 intersect the joints between panels 17 to divide the porch into a plurality of square areas defined by the edges of the floor panels 17 and the lines joining the frames 18. This provides an optional modular structure wherein the frames 18 define modular side-by-side window openings that cover the entire length of the sidewalls 22 and 24 and the end wall 21. The term "modular" herein means designed on the basis of fixed dimensions or modules composed of prefabricated parts. The use of modular construction is an optional preferred form of the present invention. The window openings 30 between the window frames 18 are of equal size. The windows themselves which will be described below are each supported within one of the window openings 30 and are also of equal size. This provides a modular porch with identical window openings 30 all of the same size and shape and together covering substantially the entire area of at least three walls 21, 22 and 24 of the porch to form what can be thought of as a window wall. The remaining wall 23 is in this case the wall of a house or other building having a door 23' that leads to the porch 10. If desired, as shown in FIG. 12, each vertical frame member 18 can be made up of two adjacent vertical boards (separated by a dotted line in the figure), instead of a single vertical board. This is the preferred modular window arrangement in which each window is prefabricated.

Extending horizontally with their ends supported on the beams 20 are a plurality of longitudinally extending parallel upper floor joists 20' upon which the edges of the floor panels 17 are supported. A box structure is formed with boards 32 (FIG. 8) over which is placed a water impervious weather stripping sheet 34, the lower end of which extends laterally toward the outside of the wall above the beam 20 as shown at 36. It should be noted that the frames 18 extend below the floor 17 all the way to the top of the supporting beam made up of the boards 20. Typically the window supporting columns 18 extend one to two feet below the floor 17. This is shown in FIG. 8.

Figures 5, 6, 7, 8:
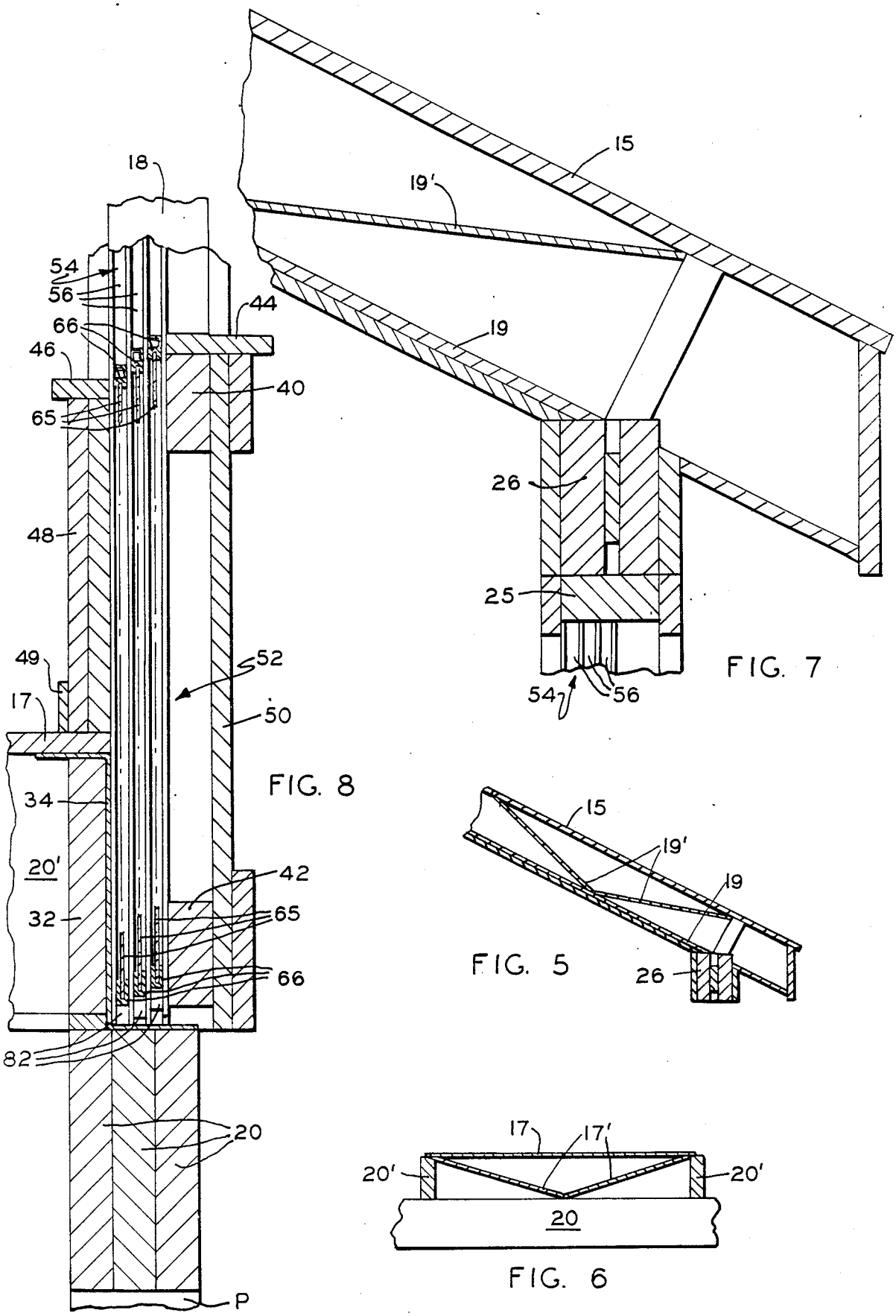
FIG. 5 is a vertical sectional view taken on line 5—5 of FIG. 2.
FIG. 6 is a vertical sectional view taken on line 6—6 of FIG. 3.
FIG. 7 is a vertical sectional view taken on line 7—7 of FIG. 2 on an enlarged scale relative to FIG. 5.
FIG. 8 is a partial vertical sectional view taken on line 8—8 of FIG. 2 on an enlarged scale.

As shown in FIGS. 1 and 8, horizontal boards 40 and 42 are nailed across the frames 18 above the floor 17 and an outer window sill 44 is nailed to the top of the board 40. An inner sill 46 is fastened to the inside edge of the window frames 18 and wainscoating 48 optionally with a baseboard 49 is nailed to the inside of the frames 18 below the sill 46. Fastened between the boards 40, 42 on the outside below the outer sill 44 is a panel which functions as a skirt 50. It will be seen that the skirt 50 extends substantially below the floor 17 as does the column 12. In this way, a pocket 52 extending below the floor 17 is provided for the window sashes as will be described below.

Affixed by nails or other fasteners to the side edges of the frames 18 are extruded metal window tracks 54 which in this case have three vertical channels or slots 56 to provide slide tracks for window sashes 56' arranged in the tracks in side-by-side planes within each window opening 30 as shown in FIGS. 8 and 18. If desired, the tracks 54 and the sashes 56' can be made of wood. The window sashes 56' are slidably supported in the tracks 56 so that they can be easily moved up and down independently. They are held in place in a desired position by means of sliding fasteners 74.

Figure 15:
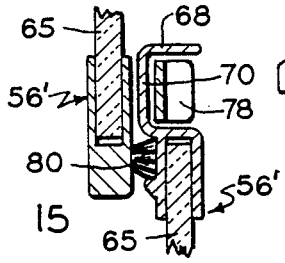
FIG. 15 is a vertical sectional view taken on line 15—15 of FIG. 14.
Figure 14:
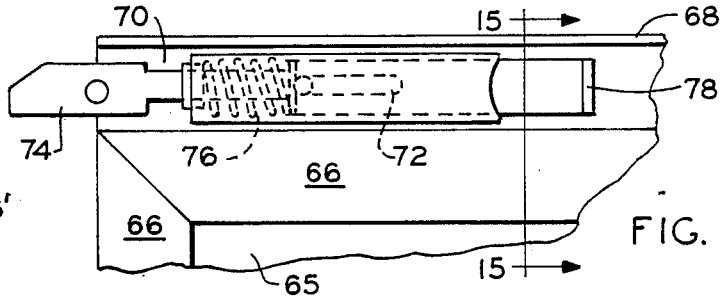
FIG. 14 is a partial elevational view of one of the window fasteners.
Figure 9:
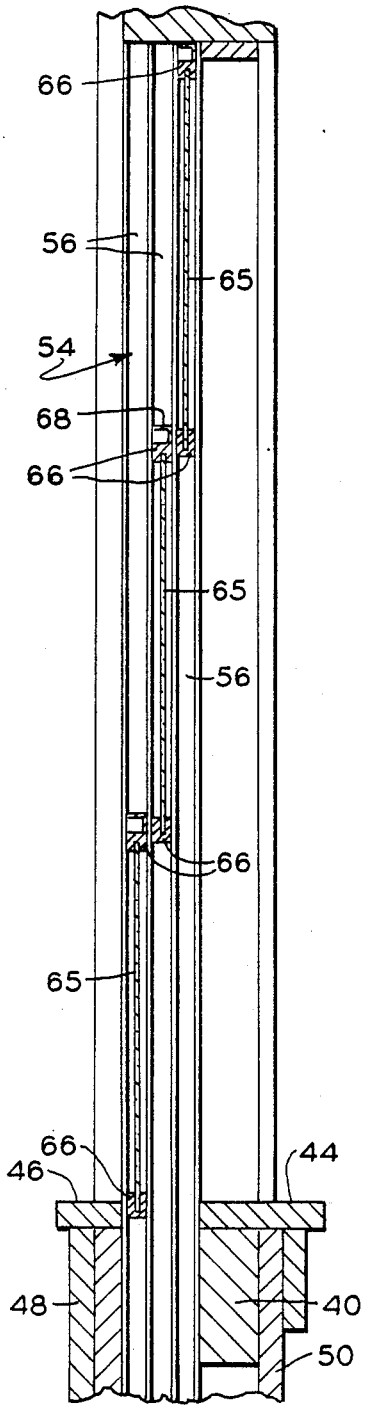
FIG. 9 is a vertical sectional view taken on line 9—9 of FIG. 2.
Figure 10:
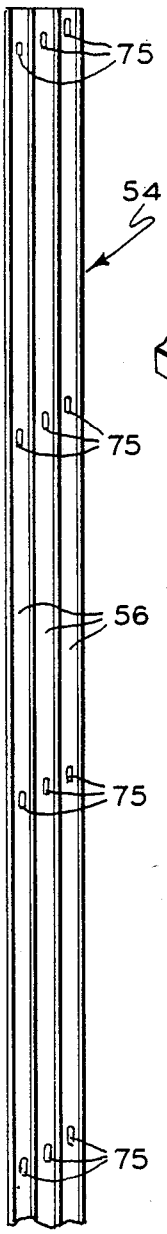
FIG. 10 is a partial side elevational view of the window support track as it appears when removed from the window casing.

As shown in FIGS. 14 and 15 the window sashes 56' include glass panes 65 supported in a rectangular extruded aluminum frame 66. The aluminum frame 66 has a top section 68 with a channel 70 which includes a guide 72 for a sliding fastener 74 which is urged outwardly, i.e. toward the left in FIG. 14 by means of a compression spring 76. The fastener 74 includes a projecting finger tab 78 which enables the fastener to be manually withdrawn from one of the openings 75 (FIG. 10) when the window sash is to be raised or lowered. The lower edge of each window sash as shown in FIG. 15 can be provided with an insulating strip formed from rubber foam, felt, fibers or other insulating material 80 to provide a seal between the next adjacent sash members when in the closed position. The free ends of the fasteners 74 normally project into openings 75 in the track 54. The openings 75 thus support the sashes 56' so that the upper sash of each adjacent pair proceeding from top to bottom overlaps the top section 68 of the sash just below it with the insulating strip 80 in position to provide a seal between each pair of adjacent sashes. It should also be noticed that the uppermost sash 56' is on the outside and the lowermost sash is toward the inside of the porch to help prevent rainwater from entering the building.

From the above discussion it can be seen that the frames 18 and tracks 54 supporting the sashes 56' define a plurality of side-by-side windows that cover substantially all of each of the walls 21, 22 and 24. The windows cover at least three of the walls and, if desired, can cover the fourth wall in case the porch is detached from the house wall 23.

At the bottom of the pocket or well 52 are provided as shown in FIG. 8 three sash stops 82, one for each of the tracks 56.

Figure 4:
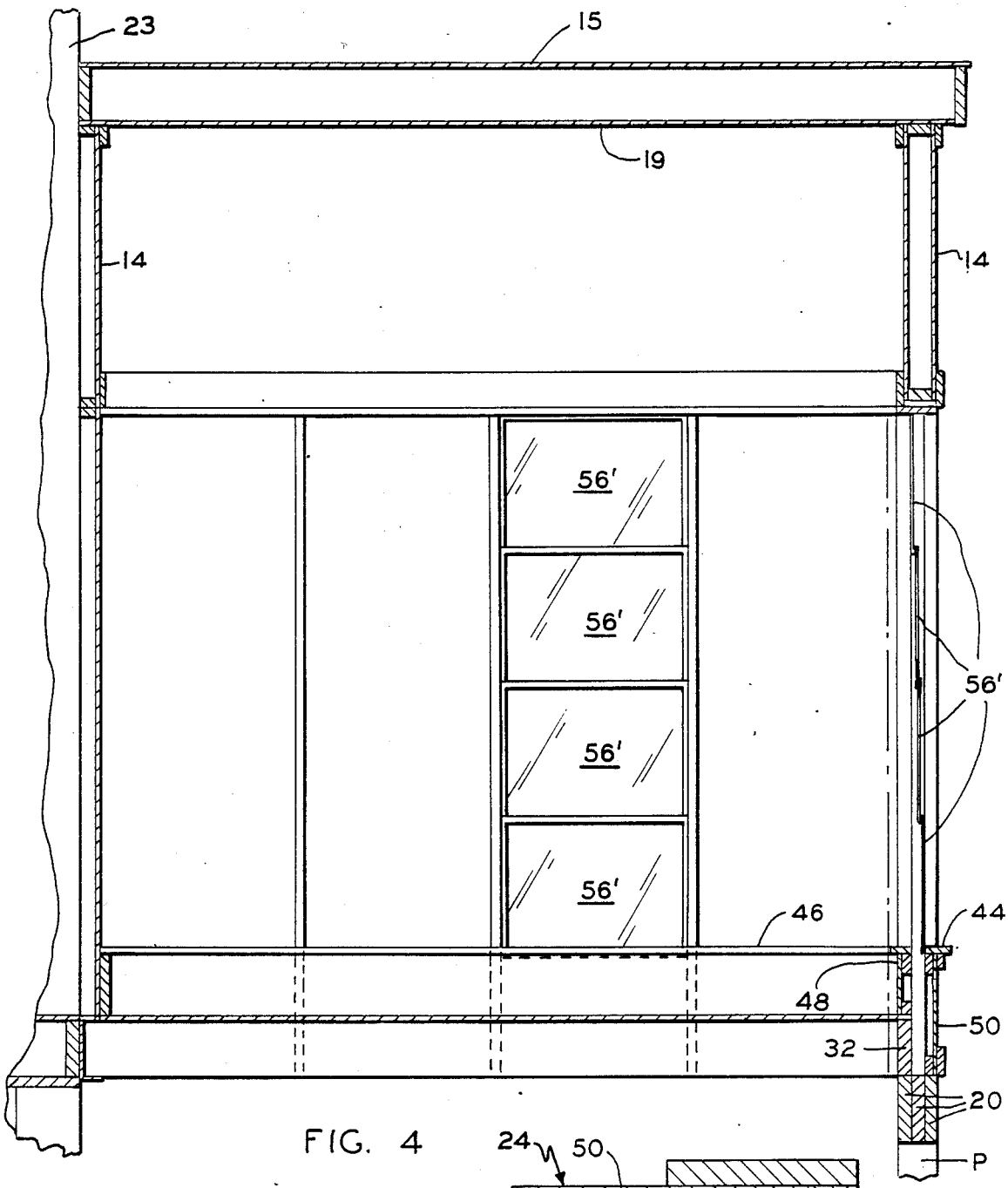
FIG. 4 is a vertical sectional view taken on line 4—4 of FIG. 2.
Figure 17:
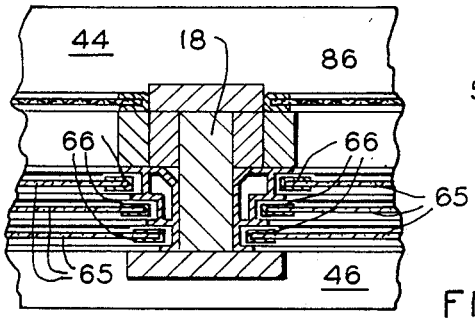
FIG. 17 is a horizontal sectional view taken on line 17—17 of FIG. 2.
Figure 16:
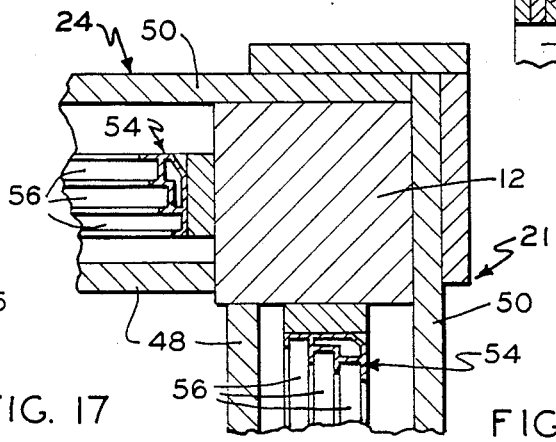
FIG. 16 is a horizontal sectional view taken on line 16—16 of FIG. 2.
Figure 11:
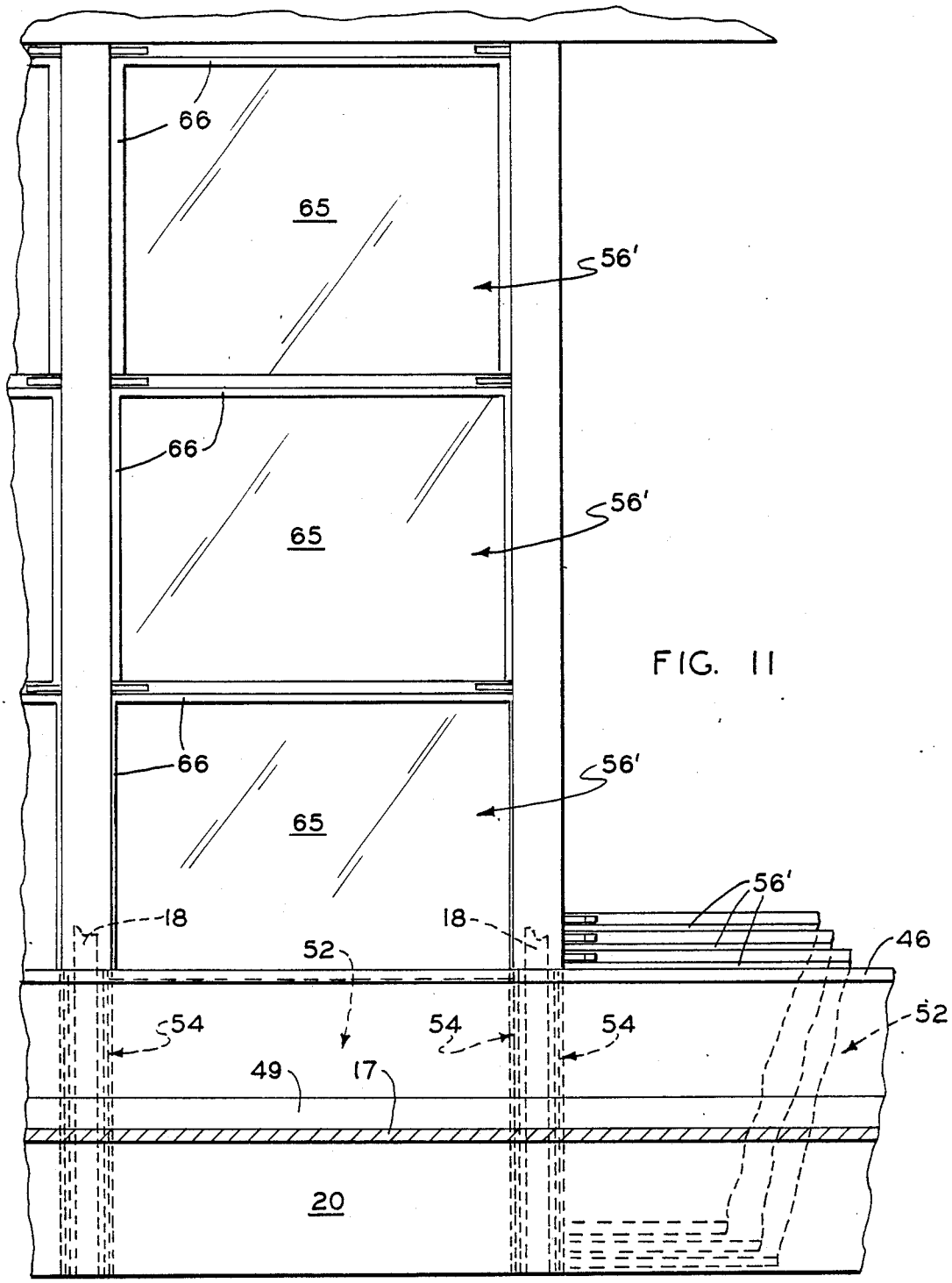
FIG. 11 is a partial view of one wall of the porch as seen from the inside.

Different numbers of window sashes 56' can be employed for different applications. For example, as shown in FIGS. 8, 11 and 18, three window sashes 56' are provided. For other applications, four window sashes 56' can be used as shown in FIG. 4. While the track 54 has been shown with channels 56 of different depths (FIG. 12), all of the tracks can be aligned, i.e. at the same depth if desired. Usually all of the windows are covered on the outside by window screen 86 (FIGS. 2 and 17), however, in some areas the window screen 86 may not be needed.

The porch 10 thus functions as a three-season porch which can be totally enclosed in the winter by raising the window sashes 56' from the pockets 52 in which they are recessed below the level of the floor 17 during the summer. The porch lends itself well to factory manufacture or can be built on the site. The modular structure enables the porch to be built in two days. The invention provides an almost unobstructed view because the window openings 30 can extend as close as desired to the floor 17. The window openings can, if desired, extend all the way to the floor with the upper edges of the sashes projecting only far enough up to be grasped so that they can be raised to the closed position. It is desirable however, to provide a 12-inch wainscoating 48 on the interior for many applications. When all of the sashes are lowered for storage in the wells 52, the invention achieves the appearance and effect of a porch without windows and yet the window sashes can be raised whenever desired to provide total enclosure.

By drawing the fasteners 74 all the way in, the window sashes 56' can be removed from the tracks entirely for cleaning.

Many variations of the invention within the scope of the appended claims will be apparent to those skilled in the art.

What is claimed is:

1. A porch having a ceiling, floor and at least one window wall, said wall being composed of a plurality of window units positioned in side-by-side relationship across the width of said wall such that a substantial part of said wall is composed of the window units, each window unit including laterally spaced apart vertically disposed parallel frames, said frames being provided on both sides of each of the window units, a multi-channel window track mounted on each side of each unit, each of the tracks including centrally opening guide channels, a window sash slidably mounted with its side edges in aligned channels for vertical sliding movement to provide a plurality of window sashes positioned in side-by-side planes that can be slid vertically in the channels, said frames and said tracks extending from a point in proximity to the ceiling of the porch downwardly to an elevation below the level of the floor of the porch, said window sashes being independently movable and slidably mounted in the channels between a raised operative position for closing the window opening and a lower storage position at least partially below the level of the floor, the lower edge of each window opening being constructed in spaced relationship above the floor by a distance that is less than the height of a single one of the sashes whereby with all of the sashes positioned at least partially below the floor the window openings extend sufficiently close to the floor to promote the visual illusion of being outside.

2. The porch according to claim 1 wherein at least three of the window sashes are provided in each window opening to cover a third of the window opening and are adapted to be lowered to a storage position in which all of the sashes in storage extend partially below the floor with their upper edges extending above the floor so that their upper edges can be grasped manually when they are to be raised to the operative position.

3. The porch of claim 1 wherein inner and outer window sills are provided adjacent the lower edge of each window opening, a skirt extends downwardly from the outer window sill below the level of the floor, wainscoating extends downwardly from the inner sill to the floor level to define a window sash storage pocket between the wainscoating and the skirt and the storage pocket having a lower portion which extends below the wainscoating and the floor to enclose the window sashes in part below the level of the floor but with their upper portions extending above the level of the floor.

4. The porch of claim 1 wherein stop means is provided for establishing the lower position of each of the window sashes, each such stop being positioned at a different elevation so that, when lowered, the outermost window sash is at the highest elevation and the innermost sash is at the lowest position with intermediate sashes at an intermediate elevation.

5. The porch of claim 1 wherein a waterproofing shield is mounted within the porch to line the inner wall of the pocket and to extend from proximity to the floor downwardly through the pocket to its lower end between the position occupied by the sashes when in storage and an inner wall of the pocket to thereby deflect rainwater that runs off the window sashes into the pocket.

6. The porch of claim 1 wherein the tracks are provided with laterally aligned openings on each side thereof and said window sashes include laterally extendable fasteners adapted to project into the aligned openings in the tracks to thereby support the window sashes within the tracks until said fasteners are withdrawn centrally from the aligned openings to permit the sashes to be raised or lowered within the channels in the tracks to an elevation below the level of the floor, and said fasteners are positioned a sufficient distance above the floor level to enable them to be grasped manually when the window sash is to be raised.

7. A porch having a ceiling, floor and at least one window wall, each of said walls being composed of a plurality of window units positioned in side-by-side relationship across the width of said wall such that a substantial part of said wall is composed of the window units, each window unit including laterally spaced apart vertically disposed parallel frames, said frames being provided on both sides of each of the window units, a window track mounted on each side of each unit, each such track includes at least one centrally opening guide channel, a plurality of window sashes slidably mounted with each side edge thereof in one of the channels for vertical sliding movement to provide a plurality of window sashes that can be slid vertically in the track, said frames and said track extending downwardly to an elevation below the level of the floor of the porch, each window sash being independently movable and slidably mounted in its channel for movement between a raised operative position for closing the window opening and a lower storage position at least partially below the level of the floor, each window opening having a lower edge constructed in spaced relationship above the floor by a distance that is less than the height of a single one of the sashes whereby the sashes can be lowered to a position at least partially below the level of the floor.

* * * * *